US005318409A

United States Patent [19]

London et al.

[11] Patent Number: 5,318,409

[45] Date of Patent: Jun. 7, 1994

[54] ROD PUMP FLOW RATE DETERMINATION FROM MOTOR POWER

[75] Inventors: Robert K. London, Bakersfield, Calif.; David G. Loucks, Sugar Land, Tex.; Denis A. Mueller, Asheville, N.C.

[73] Assignee: Westinghouse Electric Corp., Pittsburgh, Pa.

[21] Appl. No.: 35,465

[22] Filed: Mar. 23, 1993

[51] Int. Cl.[5] ..... F04B 49/00

[52] U.S. Cl. ..... 417/53; 417/18; 417/43; 417/44 J; 417/63; 73/861

[58] Field of Search ..... 417/18, 20, 43, 44 J, 417/53, 63; 73/861

[56] References Cited

U.S. PATENT DOCUMENTS

| | | | |
|---|---|---|---|
| 3,610,779 | 10/1971 | Hubby | 417/44 J |
| 4,145,161 | 3/1979 | Skinner | 417/22 |
| 4,220,440 | 9/1980 | Taylor et al. . | |
| 4,490,094 | 12/1984 | Gibbs | 417/42 |
| 4,493,613 | 1/1985 | Sommer . | |
| 4,601,640 | 7/1986 | Sommer . | |
| 4,695,779 | 9/1987 | Yates . | |
| 4,767,280 | 8/1988 | Markuson et al. | 417/44 |
| 5,070,725 | 12/1991 | Cox et al. . | |

*Primary Examiner*—Richard A. Bertsch
*Assistant Examiner*—David W. Scheuermann
*Attorney, Agent, or Firm*—M. J. Moran

[57] ABSTRACT

A pump controller coupling the electric motor of a cyclically operating well pump to a power line is arranged to measure instantaneous power consumption of the motor, to integrate the power consumption over pump cycles, and to assess the performance of the well and/or pump by using the total power consumption to estimate fluid flow. The controller determines a phase reference in the cycle of the pump by monitoring for a peak or zero crossing in the instantaneous power level, specifically the point at which the pump changes over from a power stroke to regenerative operation due to pump momentum. The integrated total power consumption is reduced by an offset factor representing frictional losses, and scaled to obtain an approximate fluid volume determination for the pump and well. The factors used for offset and scaling can be adjusted by calibration using at least intermittent measurements of actual fluid flow and fluid density. The offset factor representing friction can be monitored for deciding when maintenance is needed on the pump.

15 Claims, 3 Drawing Sheets

ROD PUMP FLOW RATE DETERMINATION FROM MOTOR POWER

BACKGROUND OF THE INVENTION

1. Field of the Invention

The invention relates to controls and monitors for oil well rod pumps and similar cyclic loads. In particular, the fluid flow rate produced by a rod pump is determined indirectly by monitoring variations in electrical loading of the pump motor. The phase position of the pump cycle is referenced by power peaks or zero crossings of the cyclic load, and electrical loading per pump cycle is integrated. An offset factor is subtracted to account for frictional loading. The remainder is converted to units of hydraulic work, thus providing an approximation of fluid flow from the pump without a direct measurement.

2. Prior Art

Oil well walking beam pumps extract fluid from a downhole pump chamber by repeatedly raising and lowering a series of steel rods coupling the downhole pump and the surface beam pumper assembly. The repetitive raising and lowering of the steel rods causes a piston in the downhole pump assembly to pull the well fluids to the surface.

The surface beam pumper assembly typically includes a rocking beam with one end coupled to a pump motor by a crank assembly. The crank assembly has a counterweight intended to balance the loading of the motor by offsetting at least part of the weight of the pump connecting rods which are cantilevered on the opposite end of the rocking beam. Nevertheless, as the rods to the downhole pump are raised and lowered, the loading of the motor passes through a cycle during which potential energy is stored as the pump rods are lifted, and released as the pump rods are lowered.

The motor is typically an electric motor that is geared down to accommodate the relatively low frequency of the pump stroke. A three phase motor is typical. Motor and circuit protection contactor devices typically are provided for breaking the motor circuit in the event of a short circuit or motor overload. Additionally, a controller that is responsive to conditions in the well may be coupled to the contactor devices, for example to operate the pump intermittently at a rate that can be supported by the geological formation. The controller or the contactor device itself may include means for measuring the current in the motor circuit and/or the line voltage by analog or digital circuits, as a part of the circuit protection function, as well as to vary the operation of the pump to suit conditions at the best efficiency.

It is known to provide a contactor for an oil well with relay contacts that rearrange the line couplings of a three phase motor when current loading conditions indicate that the pump is operating inefficiently, for example as disclosed in U.S. Pat. No. 4,220,440—Taylor et al. U.S. Pat. No. 4,695,779—Yates discloses a similar controller that includes a processor and a number of timers that switch between operational modes upon the occurrence of distinct stall conditions.

A processor with a range of flow and energy consumption sensors for assessing well operation is disclosed in U.S. Pat. No. 4,767,280—Markuson, and a processor that integrates additional factors such as the proportions of oil and water in the recovered fluid is disclosed in U.S. Pat. No. 5,070,725—Cox et al.

Although the invention is described herein primarily with reference to a walking beam pump, it is also possible to apply the concepts of a walking beam pump to other forms of cyclic loads. U.S. Pat. Nos. 4,601,640 and 4,493,613, both to Sommer, for example, disclose a compact pump arrangement that reciprocates a piston but does not employ a beam. Instead, a reversing motor manipulates the piston via a cable. These, and the foregoing U.S. Patent disclosures are hereby incorporated by reference, for their teachings of well motor control and sensing arrangements.

Wells are frequently instrumented for purposes of assessing operational parameters. The fluid flow rate produced by the well is an advantageous parameter to measure, and can be measured using flow rate sensors at any point along the conduits through which the fluid is pumped. The fluid pressures produced in the well by the pump can also be monitored, and used to develop additional information, such as the rate at which the geological formation is refilling the pump, and other aspects of well performance. One means for sensing well fluid pressure indirectly is to sense tension and compression of the moving pump structures, for example using strain gauges mounted on such structures or load cells coupled between them.

There are a number of aspects of well and/or pump performance that are pertinent to issues of efficiency, maintenance, capacity, switching between operational modes and the like. The object for the well is of course to supply the maximum fluid possible, and preferably to maximize the percentage of the fluid that is oil rather than water or mud while minimizing the power consumption of the pump. However, optimizing pump operation requires that the operation of the pump be varied to suit conditions. A monitoring system and controller can be provided to sense conditions and to adjust operational parameters such as the frequency of cyclic operation, the manner in which power is coupled to the motor windings and so forth.

The amount of useful work that a fluid transport device performs is the product of the mass rate of fluid flow and the pressure differential or elevation head. The total head borne by the pump includes static and dynamic factors such as the discharge head and the suction head maintained, a velocity head, frictional resistance, etc. The variations in a number of these factors, especially fluid pressure and fluid flow, is cyclic due to the cyclic operation of the pump. It is therefore necessary to assess fluid pressure and flow information as a function of the point at which such data is sampled in the periodic cycle of the pump. The monitoring and control system of the pump thus requires the input of information on the present phase angle of the pump.

The phase angle of the pump can be measured by more or less sophisticated means. For example, a limit switch can be mounted for repetitive operation by contact with the pump beam, and used to trigger sampling of process data at the same point during every cycle, or between counted cycles. A shaft angle encoder can be mounted to produce pulses with angular displacement of the beam or of the motor crank, etc., which allows measurements to be taken at defined points in the cycle. These devices require proper setup and maintenance, and can suffer from mechanical failure. Thus the known arrangements are expensive both initially and with continuing maintenance and use.

It would be advantageous to provide a device that can determine information needed for assessing or controlling pump operation using a minimum of components. The present invention is arranged to develop such information indirectly from variation in the loading of the pump motor. In particular, the invention determines an approximate fluid flow rate from the well by integrating the instantaneous level of electric power applied to the pump motor over full cycles of the pump, as referenced to a phase angle determined during each pump cycle from the point of minimum instantaneous power consumption.

SUMMARY OF THE INVENTION

It is an object of the invention to assess operational parameters of a cyclic load such as a well pump from the electrical loading of a motor operating the pump.

It is also an object of the invention to determine the flow rate from a pump by integrating the instantaneous power to a pump motor over full cycles of pump operation, taking into account an offset representing the frictional power dissipation of the pump when operating but not producing fluid.

It is a further object of the invention to provide a pump controller that develops information for assessing the operation of a well and well pump with minimal reliance on sensors, using instead the variations in power consumption of the pump motor, as detected by the pump controller.

It is another object of the invention to employ a power sensor coupled to a motor protection circuit for a pump, such as an accessory to a circuit breaker, to develop a power consumption signal, and to obtain from the power consumption signal information on the flow rate produced by the pump.

These and other objects are accomplished according to the invention using a pump controller coupling the electric motor of a cyclically operating well pump to a power line. The pump controller is arranged to measure instantaneous power consumption of the motor, to integrate the power consumption over pump cycles, and to assess the performance of the well and/or pump by using the total power consumption to estimate fluid flow. The controller determines a phase reference in the cycle of the pump by monitoring for a peak or zero crossing in the instantaneous power level, specifically the point at which the pump changes over from a power stroke to regenerative operation due to pump momentum. The integrated total power consumption is reduced by an offset factor representing frictional losses, and scaled to obtain an approximate fluid volume determination for the pump and well. The factors used for offset and scaling can be adjusted by calibration using at least intermittent measurements of actual fluid flow and fluid density. The offset factor representing friction can be monitored for deciding when maintenance is needed on the pump.

The invention simply requires the use of a watt sensor and means for processing the output of the watt sensor to integrate power consumption levels. A plurality of pumps can be monitored in this manner using one processor collecting power data via multiplexed data communications with the power consumption sensors. The power sensors can be inexpensive modular accessories coupled to the contactor or circuit breaker arrangements used for protection against electrical faults.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
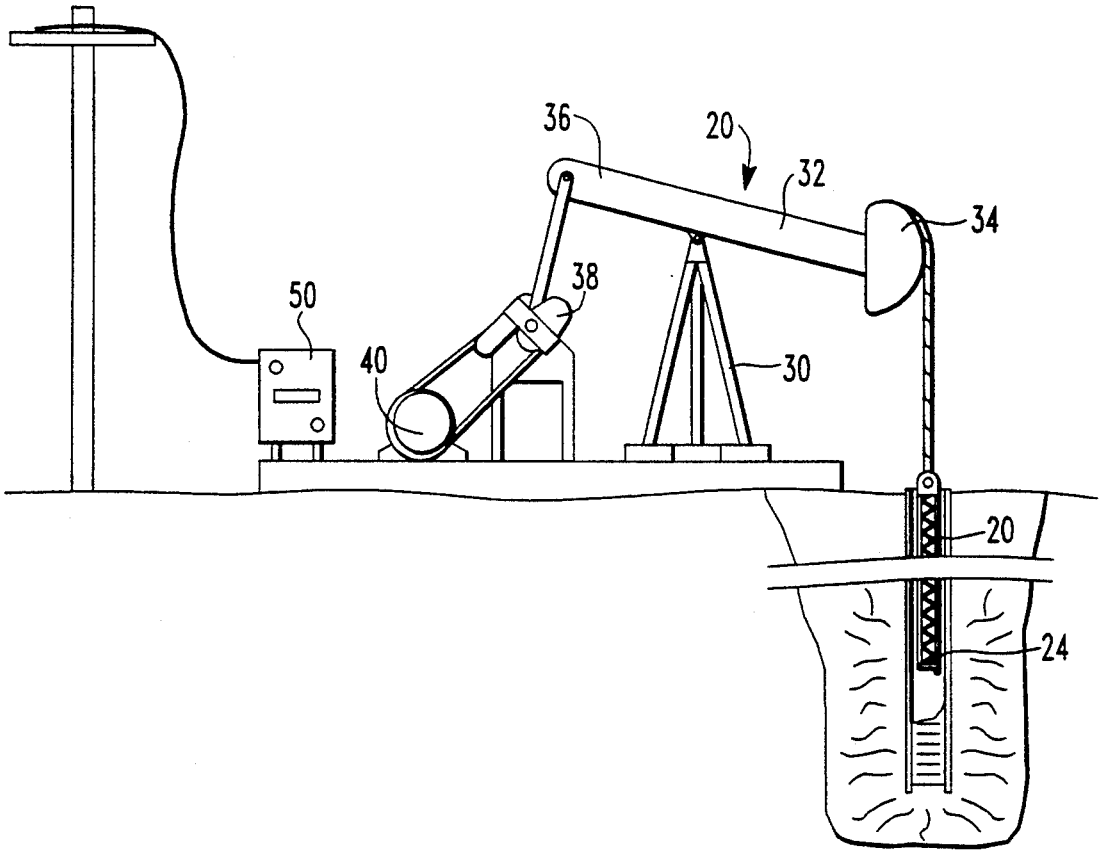
FIG. 1 is an elevation view showing a cyclically operated pump arrangement according to the invention.

As shown in FIG. 1, a well pump arrangement 20 according to the invention has a series of connecting rods 22 coupling a downhole piston/chamber pump 24 to a surface walking beam pumper 30. The surface pumper 30 has a rocking beam 32 with one end 34 connected to the downhole rods 22 and an opposite end 36 connected by eccentric linkages to a rotating counterweight member 38. The counterweight member 38 is rotated by an electric motor 40, being coupled by a belt or chain drive, and/or coupled to the motor 40 through a gear train. As the motor 40 turns the counterweight member 38, the beam 32 is rocked to raise and lower the downhole rods 22, operating the pump 24 in a periodic manner at a relatively low frequency.

The motor 40 can be a three phase multi-winding AC motor, for example operable at 440 VAC, and developing 10 to 125 horsepower, depending on the capacity and depth of the pump 24. As shown schematically in FIG. 2, the pump arrangement 20 can be provided with a contactor 44 operable to activate and deactivate pumping, to change the winding configuration between Y, ΔY and as disclosed in U.S. Pat. Nos. 4,220,440—Taylor and 4,695,779—Yates, and/or can be coupled to an overload/underload controller including a processor and timing means as in U.S. Pat. No. 4,767,280—Markuson et al, each of which patents is incorporated herein by reference.

According to the invention, a controller 50 of this general type is arranged to calculate the values of process variables from the electric power applied to the pump motor 40. As a result, well and pump performance monitoring data is obtained and decisions can be made for controlling operation of the pump 20, with no or minimal reliance on sensors for detecting tension, compression, flow rate, pressure and other similar variables that might otherwise be used to assess the pumping operation.

Figure 2:
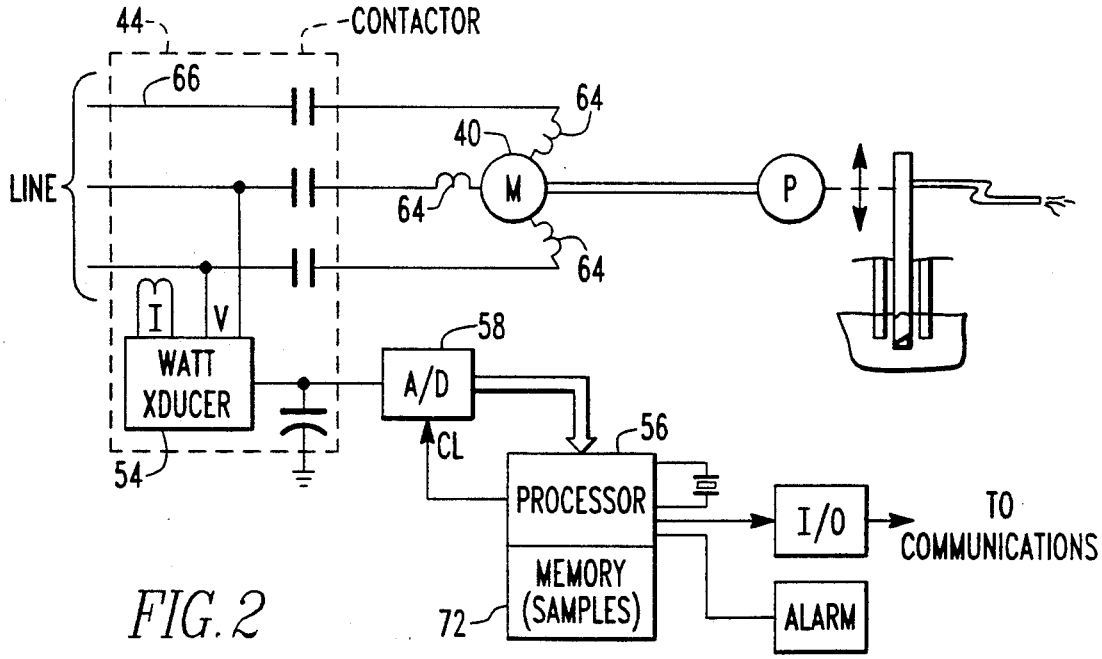
FIG. 2 is a schematic block diagram showing the functional elements of the invention.

Referring to FIG. 2, the controller 50 is coupled to a transducer 54 operable to sense the instantaneous electric power level drawn from the power line 66 by the electric motor 40 operating the well pump 24. In the embodiment shown, the controller 50 comprises a digital processor 56 and the transducer 54 comprises a watt transducer that produces a voltage output proportional to the instantaneous power level. The voltage output is sampled using an analog to digital converter 58 clocked periodically by the controller 50, at a frequency substantially higher than the frequency of cyclic pump operation, e.g., several times per second. The watt transducer 54 averages the AC power consumption of the motor 40 over the power line frequency, but produces a substantially sinusoidal output signal at the frequency of the pump 24. This occurs because as the pump 24 raises and lowers the downhole pump rods 22 during each pump cycle, the motor 40 is cyclically loaded. The pump arrangement 20 passes through a power stroke, and then with continuing momentum passes through a regenerative stroke, each cycle including the power and regenerative portions.

Motor loading is at its minimum during the times that the beam 32 is at the top and bottom of its stroke. An absolute minimum occurs immediately preceding the downstroke portion of the cycle. The power at this point typically reverses and becomes negative as the momentum of the pump 24 and connecting rod structures 22 cause regeneration of the motor 40. The watt transducer 54 is responsive to the polarity of the power applied to or generated by the pump motor 40. A watt transducer that can be used according to the invention is the Energy Sentinel TM watt transducer marketed by Westinghouse Electric Corporation. This transducer is a modular accessory to the circuit breaker typically used for providing protection against electrical faults.

The watt transducer 54 effectively measures the RMS current in the motor windings 64 and the RMS voltage across the power line 66, and multiplies these values to produce the output presented to the analog to digital converter 58 representing the instantaneous power level. It is also possible to approximate the instantaneous power level by measuring only for current, thus assuming that the voltage level remains at the nominal voltage of the power grid. Reliance on a measurement of current is less accurate than taking current and voltage into account, due to the reactive nature of the electrical load, particularly as the motor 40 is cyclically loaded and regenerated. In addition, it is necessary to determine whether the current is driven from the power grid or from regeneration of the motor. Accordingly, power or current "consumption," as used herein, should be construed to include regeneration or negative power consumption.

Preferably, the invention is embodied as an improved form of pump controller of the type known as a "pump panel" in the industry, but is provided with additional computational capabilities in order to effect the objects of the invention. The smart pump panel of the invention can be based on an electromechanical contactor—motor starter or circuit breaker arrangement such as the Advantage TM three phase contactor marketed by Westinghouse Electric Corporation, preferably including the Energy Sentinel TM watt transducer module that is mounted on the starter and includes current and voltage sensing circuits, a filter and multiplying arrangement, and an analog to digital converter for producing a digital output representing the instantaneous energy consumption of a load (and regeneration from the load), such as motor 40. The digital data is coupled to a programmable controller forming the processor 56 of the controller 50, and is read, for example, every 150 to 200 mS to collect instantaneous power consumption data. The programmable controller is coupled to input-/output modules whereby the sample data and the data generated by computation from the sample data and/or from additional sensor inputs can be communicated to recording or communication devices. Preferably, the output data developed by the controller 50 is communicated by radio modem, line drivers, telephone modem or the like to a remote location. The data developed by the watt sensors of a plurality of pumps can be multiplexed to a single controller, and/or the outputs generated by a plurality of controllers can be fed by appropriate communications to a more centralized control means. It is also possible to use the data only locally, in connection with a pump-off type controller (for determining when and for how long the pump should run) that has the additional capabilities discussed herein.

Figure 3:
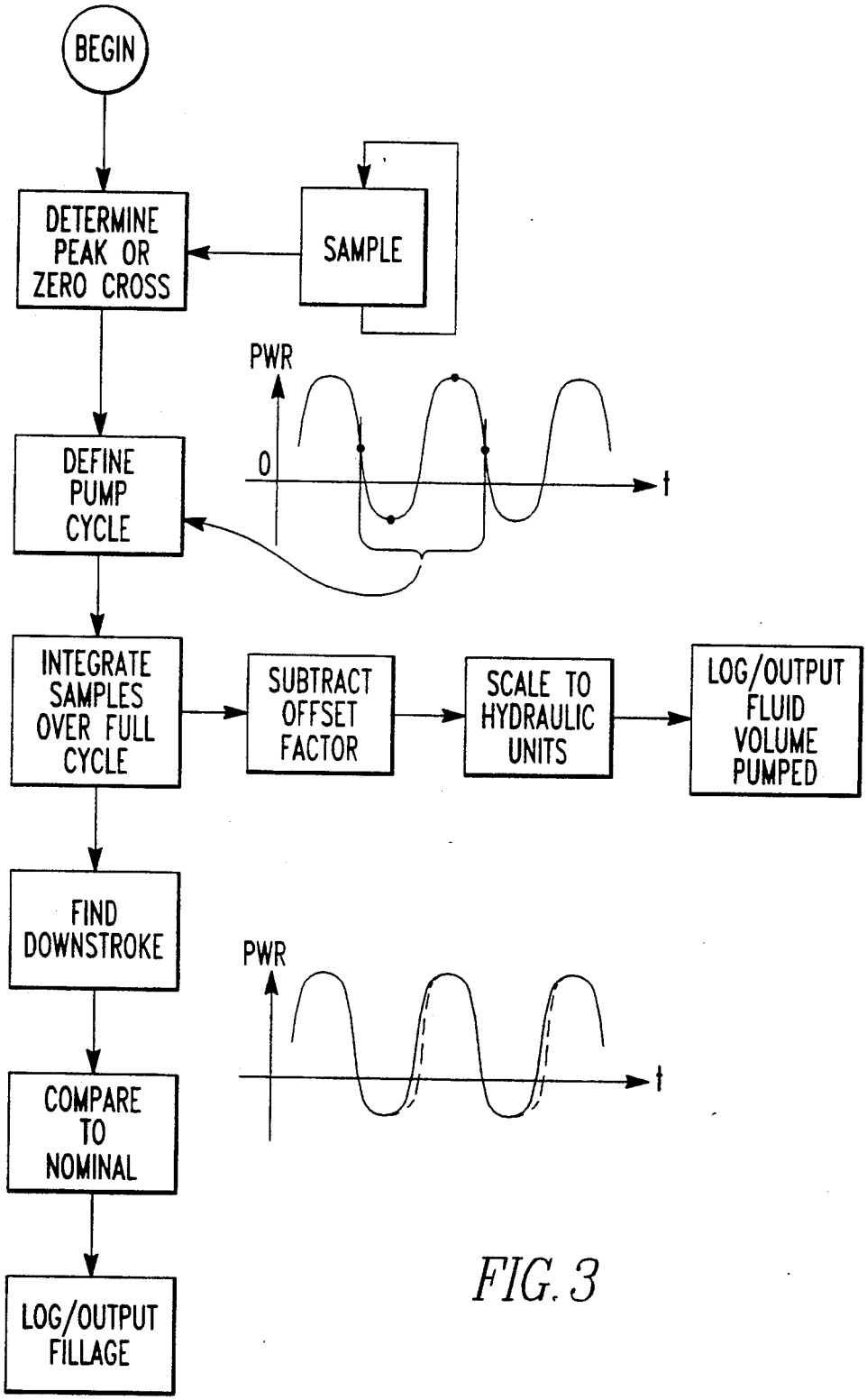
FIG. 3 is a flowchart illustrating the measurement and processing steps according to the invention.

As shown by the flowchart diagram of FIG. 3, the processor 56 of the controller 50 stores the data representing the sampled power level and processes the data to determine the times at which successive minimums occur. These minimums define the operational pumping frequency. The controller 50 then integrates the detected instantaneous power level by adding the sampled data values over a complete pump cycle. The result is a value proportional to hydraulic power exerted during the cycle, plus a value representing the frictional losses of the pump arrangement 20 and motor 40 as a whole.

The integrated power level over the pump cycle is stored or logged, to enable analysis and comparison of the power levels over a number of cycles. The controller 50 can be arranged to store the data in a local memory 72 and/or to record the data for longer term storage on a tape or disk, to print reports or graphic plots, or to report the data via remote communication, e.g., over a modem.

The hydraulic power exerted and the frictional loss both vary over time and for successive pump cycles. However, frictional losses tend to vary very slowly in comparison to the variation of the hydraulic power or useful work exerted by the pump 24. The power variances over a relatively short period (e.g., less than one day) are primarily due to changes in hydraulic power. According to the invention these power variances are correlated to the useful work accomplished by the pump, i.e., to the volume of fluid extracted from the well.

The variations in hydraulic horsepower (i.e., the changes over periods longer than the pump cycle frequency) can be analyzed and used in a number of ways. In addition to reporting the approximate volume of fluid pumped, the variations can be used to make operational and maintenance decisions. Contactor 44, operated by outputs from the controller 50, can activate and deactivate the pump 24, change the configuration of pump motor windings 64, operate alarms or signals for maintenance, and otherwise manage the pump arrangement 20 for efficient operation, relying substantially on the information available to the controller 50 by monitoring the electric power consumption of the pump motor 40.

Figure 4:
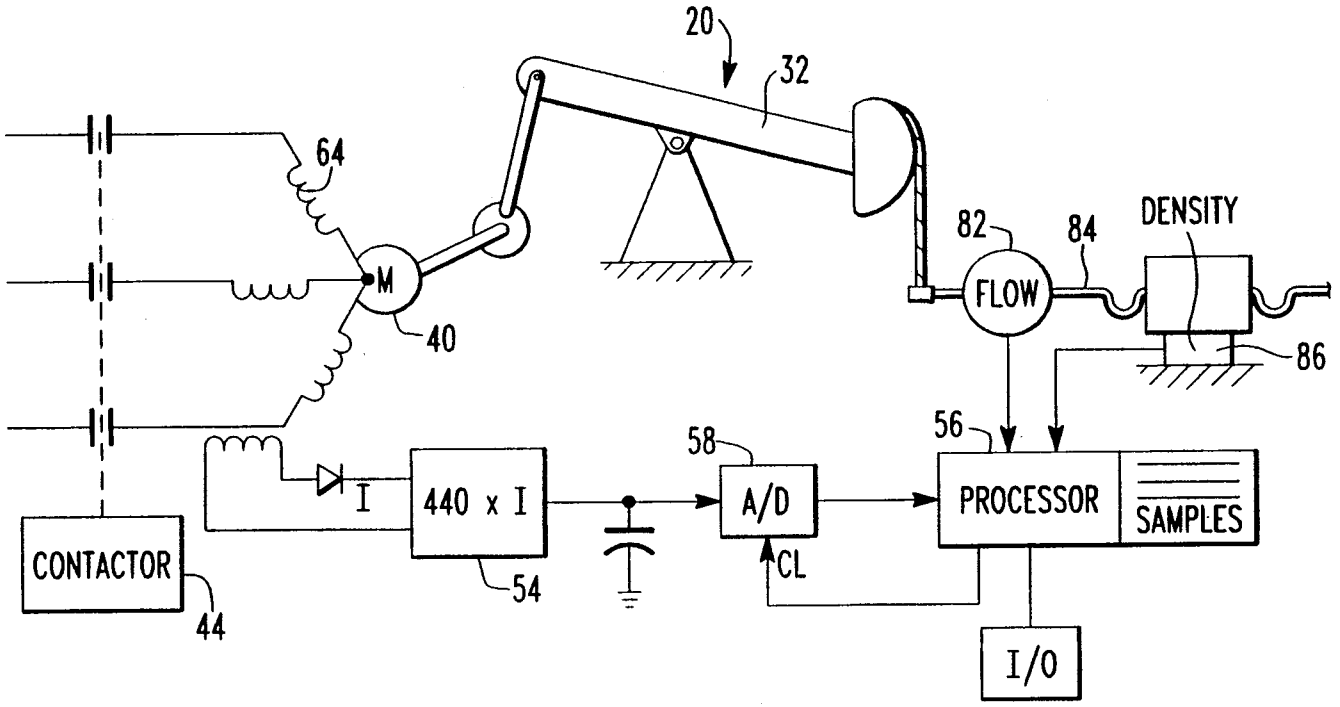
FIG. 4 is a schematic block diagram showing an alternative arrangement wherein the instantaneous power consumption is determined from the RMS current level and polarity.

FIG. 4 illustrates an alternative embodiment wherein the power level is sensed from the instantaneous current level, the current sensor producing an output representing the amplitude of the current and its polarity (i.e., whether the current is being coupled from the power grid to the motor or regenerated from the motor to the power grid). Additionally, the embodiment shown is provided with sensors 82, 86 for more accurately processing the sampled power level for distinguishing the useful work exerted by the pump 24 from frictional losses and other overhead. At least one flow sensor 82 is mounted along an output conduit 84 of the pump 24 and is coupled to the processor 56 for collecting flow data by direct measurement. The flow sensor 82 is operable at least intermittently to measure fluid flow for calibrating the calculations undertaken by the processor 56. Instantaneous flow data is also integrated over a pump cycle. The actual fluid flow during a cycle, or preferably the actual fluid flow averaged over a number of cycles, is scaled for conversion from units of hydraulic work (e.g., the product of the fluid head elevation lifted, times the integrated flow volume and average weight, is converted to units of electric power, e.g., watt-hours) and is subtracted from the measured total electrical load to determine the proportion of the power lost to friction. The friction losses can be monitored over time to determine when pump maintenance is required. The offset factor applied to the integrated electric power data can be updated using actual measurement data in this manner, whereby it is not necessary to operate the flow sensor constantly.

As also shown in FIG. 4, a density sensor 86 is also preferably mounted along an output conduit 84 of the pump 24 and is coupled to the controller processor 56 to provide a further improvement in accuracy. The density sensor 86 is operable to measure the density of the pumped fluid, which typically includes oil, water and mud. The proportions of water and mud affect the work required to lift the fluid. The processor 56 preferably is operable to factor the density into account in calculating a fluid output volume of the pump 24 as a function of the integrated work data and the density, this data also being logged and reported. The flow and density sensors can produce analog or digital outputs in known manner. Analog values are coupled to the processor 56 through an analog to digital converter. Pulsed digital signals can be coupled to the processor 56 via a counter or used to trigger a processor interrupt. Digital numeric values can be coupled to processor inputs. Shared data communications arrangements such as time or frequency division multiplexing can be used to service a number of pumps and their sensors via a single centralized control means, or to log or otherwise process data from a number of controllers associated with individual pumps or groups of pumps.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A method for monitoring a well having a cyclic well pump driven by an electric motor, comprising the steps of:

measuring an instantaneous electric power level applied to the motor;

integrating the instantaneous electric power level over repetitive cycles of operation of the pump, and accumulating a total power consumption of the motor;

subtracting from the total power consumption of the motor an offset factor representing power dissipated in frictional aspects of pump operation to obtain a remainder representing hydraulic work of the pump; and, scaling the hydraulic work as thereby determined by a scaling factor to approximate fluid flow from the pump, and logging said fluid flow for assessing operational parameters of the pump and the well.

2. The method according to claim 1, further comprising measuring a density of fluid produced by the pump, and further comprising determining a fluid output volume of the pump as a function of the hydraulic work and the density.

3. The method according to claim 1, further comprising making a measurement of actual fluid flow from the pump at least intermittently, and further comprising adjusting at least one of the offset factor and the scaling factor for more accurate calibration.

4. The method according to claim 3, comprising adjusting the offset factor, and further comprising comparing the offset factor to at least one threshold and signalling for maintenance when the offset factor passes the threshold.

5. The method according to claim 1, further comprising storing and processing the instantaneous power level for identifying at least one of a positive peak instantaneous power level, a negative peak instantaneous power level and a zero crossing of the instantaneous power level during the cycles, and wherein said integrating step is accomplished for at least a subset of the cycles over a monitoring period.

6. The method according to claim 5, wherein the reference point is a point of minimum instantaneous power consumption occurring between a power stroke in said cycles and regeneration by the motor due to momentum of the pump.

7. A pump controller for a well pump having pumping means operated cyclically under power of an electric motor coupled to a power line, comprising:

means for measuring an instantaneous level of power coupled between the motor and the power line, said means for measuring producing an output as a function of a product of the current and voltage representing instantaneous electrical power consumption of the motor;

means for determining a time of passage of the well pump through a reference point in periodic cycles of the well pump; and, a processor operable to integrate the output of said means for measuring the power, during the periodic cycles, and to accumulate a total power consumption of the pump during the cycles, the processor being operable to subtract an offset factor from the total power consumption representing frictional losses and to log a remainder as an indicator of hydraulic work accomplished by the pump, the hydraulic work being substantially representative of fluid flow from the pump.

8. The pump controller according to claim 7, further comprising a flow sensor mounted along an output conduit of the pump and coupled to the processor, the flow sensor being operable at least intermittently to measure fluid flow for calibrating the processor.

9. The pump controller according to claim 7, further comprising a density sensor mounted along an output conduit of the pump and coupled to the processor, the density sensor being operable to measure density and the processor being operable to calculate a fluid output volume of the pump as a function of the hydraulic work and the density.

10. The pump controller according to claim 7, wherein the passage of the pump through the reference point is determined by the processor by one of a relative peak and a zero crossing in the instantaneous electrical power consumption.

11. The pump controller according to claim 10, wherein the reference point is a point of minimum power consumption occurring between a power stroke in said cycles and regeneration by the motor due to momentum of the pump.

12. An oil well arrangement, comprising:

a well pump having an electric motor operable to reciprocate a piston and chamber structure disposed in a well bore;

a pump controller coupled between the well pump and an electric power line, the controller including means for measuring an instantaneous level of power coupled between the motor and the power line, the controller having means for detecting at least one of a peak and a zero crossing in the instantaneous power level, thereby defining a time of passage of the well pump through a reference point in each of the periodic cycles of the well pump, and the integrating the instantaneous power level over the periodic cycles to accumulate data representing a total power consumption of the pump during the cycles;

means coupled to the data representing the total power consumption operable to subtract an offset factor from the total power consumption representing frictional losses and to log a remainder as an indicator of hydraulic work accomplished by the pump, the hydraulic work being substantially representative of fluid flow from the pump.

13. The oil well arrangement according to claim 12, wherein the reference point is a point of minimum power consumption occurring between a power stroke in said cycles and regeneration by the motor due to momentum of the pump.

14. The oil well arrangement according to claim 12, further comprising a flow sensor mounted along an output conduit of the pump and coupled to the controller, the flow sensor being operable at least intermittently to measure fluid flow and the controller being operable to update at least one of the offset factor and the scaling factor for more accurate assessment of the fluid flow from the total power consumption.

15. The oil well arrangement according to claim 12, further comprising a density sensor mounted along an output conduit of the pump and coupled to the controller, the density sensor being operable to measure density and the controller being operable to calculate a fluid output volume of the pump as a function of the hydraulic work and the density.

* * * * *